United States Patent [19]

Fitzsimmons, Jr.

[11] Patent Number: 4,503,955

[45] Date of Patent: Mar. 12, 1985

[54] MODULAR CARRYING CASE

[76] Inventor: John J. Fitzsimmons, Jr., Stop 7, Westmoreland, N.Y. 13490

[21] Appl. No.: 474,264

[22] Filed: Mar. 11, 1983

[51] Int. Cl.[3] ..... A45C 7/00

[52] U.S. Cl. ..... 190/107; 190/22; 190/124

[58] Field of Search ..... 190/100, 103, 107, 108, 190/109, 110, 111, 112, 122, 123, 124, 125, 126, 24, 28, 21, 22

[56] References Cited

U.S. PATENT DOCUMENTS

| | | | |
|---|---|---|---|
| 2,875,868 | 3/1959 | Powell | 190/107 |
| 3,088,623 | 5/1963 | Parker | 190/28 |
| 3,330,388 | 7/1967 | Stein | 190/110 |
| 3,938,630 | 2/1976 | March | 190/24 |
| 4,008,790 | 2/1977 | Eiteljorg | 190/103 |
| 4,020,930 | 5/1977 | Weber | 190/107 |
| 4,448,292 | 5/1984 | Comfort | 190/107 |

FOREIGN PATENT DOCUMENTS

| | | | |
|---|---|---|---|
| 2214251 | 10/1973 | Fed. Rep. of Germany | 190/122 |

*Primary Examiner*—Stephen Marcus
*Assistant Examiner*—David Voorhees
*Attorney, Agent, or Firm*—Bruns and Wall

[57] ABSTRACT

A modular carrying case of all metal construction that includes a top cover section and a bottom cover section that can be closed against each other to provide a totally enclosed case or alternatively closed against one or more center sections to provide a case of greater carrying capacity. Each of the cover sections and the center section are fabricated from a metal extrusion that is formed into a generally endless loop. The peripheral edges of the abutting sections are equipped with interlocking joints that serve to form an extremely tight closure when the case is placed in a closed condition.

10 Claims, 8 Drawing Figures

MODULAR CARRYING CASE

BACKGROUND OF THE INVENTION

This invention relates to an improved all metal carrying case and, in particular, to a modular carrying case system which can be quickly expanded or taken apart without the need of special tools or the like.

In U.S. Pat. No. 3,841,727 to Peng there is disclosed a modular system in which cube-like units are either stacked one upon the other or cojoined in a contiguous side-by-side relationship to create different geometric patterns. Although the system appears best suited for generating different shaped pieces of furniture, it is also stated that it can be used to create pieces of luggage. In its basic form the system contains two sections, each of which has an open top and one open side. The sections, in assembly, are cojoined so that one section closes the other. Interlocking rails are utilized to allow the sections to slide over each other in assembly. Accordingly, bringing the various components of the system together requires a rather complex mechanism and, as a result, building up or taking apart of the modular sections is rather difficult.

In U.S. Pat. No. 3,730,309 to Hamann, there is described a carrying case having a number of the main structural elements made of extruded metal parts which add strength and rigidity to the case. The metal extrusions are cojoined by wooden side wall panels. Wooden top and bottom wall panels are also used in the case construction. These wooden sections can be easily damaged or broken in the event the case is dropped or struck a sharp blow or kick. The construction of the case furthermore does not provide for the addition of modular units once the case has been assembled.

SUMMARY OF THE INVENTION

It is a primary object of the present invention to improve carrying cases.

A further object of the present invention is to provide an all metal modular carrying case that has removable sections whereby the configuration of the case can be quickly changed without the use of special tools or the like.

A still further object of the present invention is to provide a modular carrying case having an all metal construction that is easily fabricated to create an extremely strong structure.

Another object of the present invention is to provide a modular carrying case having interlocking sections made of metal extrusions whereby cases of different sizes and shapes can be manufactured without changing the basic design of the case.

These and other objects of the present invention are attained by means of a modularized carrying case having top and bottom sections and one or more removable center sections. Each section is made from a metal extrusion that is formed into an endless rectangular loop having a flat web discribing the side wall of the section and a pair of peripheral end flanges. The end flanges are arranged to interlock with each other to form tight fitting joints when the sections are closed one on top of the other. Metal end panels can also be mounted within the end flanges to selectively close one or both ends of each section. The sections are cojoined by break apart hinges and standard locking clasps.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
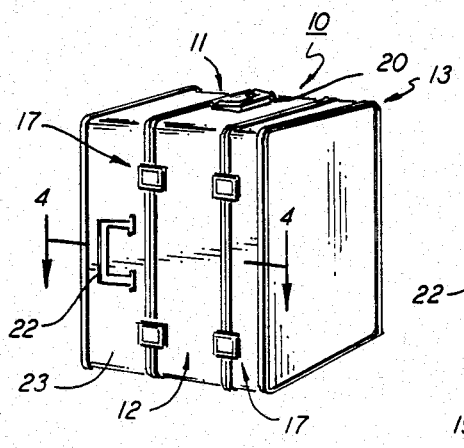
FIG. 1 is a perspective view of an all metal carrying case embodying the present invention showing the case in a closed condition.
Figure 2:
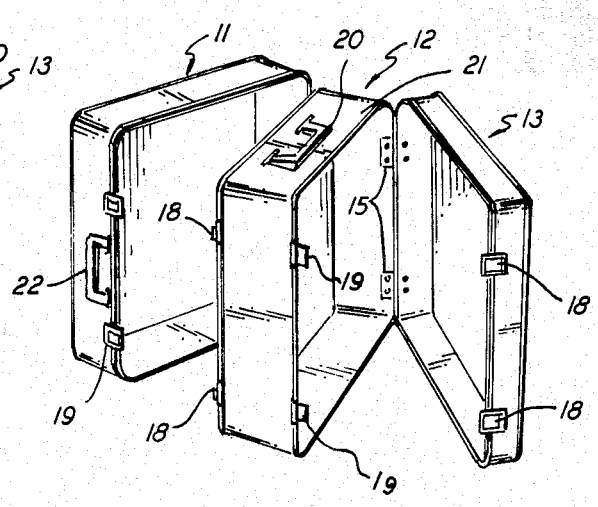
FIG. 2 is a perspective view of the case shown in FIG. 1 illustrating the top and bottom cover sections opened about a removable center section.

Referring initially to FIGS. 1 and 2, there is illustrated an all metal carrying case that is generally referenced 10 embodying the teachings of the present invention. In this particular embodiment of the invention, the case includes a bottom cover section 11, at least one center section 12 and a top cover section 13. The three sections are cojoined along the back wall of the case through the use of conventional take apart hinges 15—15. The take apart hinges, which are well known and readily available within the industry, allow the various case forming sections to be quickly and easily assembled or disassembled to change the case configuration. For example, the center section or sections may be removed and the top and bottom cover sections reassembled to provide a carrying case having a reduced capacity. By the same token, the case can be disassembled and more or different center sections added to the case to either change its function and/or increase its capacity. Through the use of this modular approach, the present carrying case can be adapted for use in an extremely wide range of applications.

The front wall of the assembled case contains a series of locking units 17—17 for securing the hinged sections together when they are closed in seating contact one against the other. Each locking unit contains a first male member 18 and a coacting female member 19. In this particular arrangement, a pair of spaced apart male members 18—18 are secured by any suitable means in a spaced apart relationship along one peripheral edge of the bottom cover section and a pair of coacting female members 19—19 are similarly secured to the top cover section. Accordingly the top and bottom cover sections can be connected together at the hinges and locked in a closed condition to furnish a complete and wholly contained case. The center section or sections likewise contain a pair of spaced apart male locking members secured along one peripheral edge and a second pair of similarly spaced apart female members secured along the opposite peripheral edge. The center sections can thus be quickly added to or removed from the case assembly without the need of special tools or the like or without having to modify the sections in any way.

A carrying handle 20 of any suitable design is secured, as by rivets, to the top wall 21 of the center section 12 of the case. A second handle 22 is also secured to one side wall 23 of either the top or the bottom section of the case. Through use of two separate handles mounted in the manner herein described, the case can be assembled in a wide variety of different configurations without having to sacrifice the convenience afforded by a handle.

Figure 3:
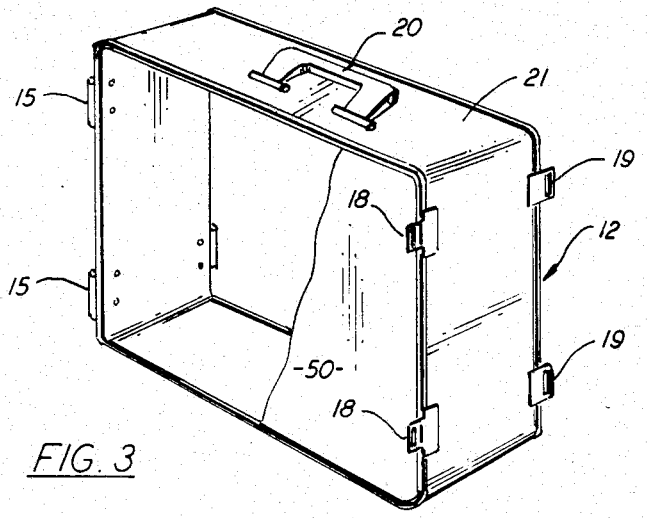
FIG. 3 a slightly enlarged perspective view of the center section of the case shown in FIGS. 1 and 2 with the bottom panel of the section partially broken away.
Figure 4:
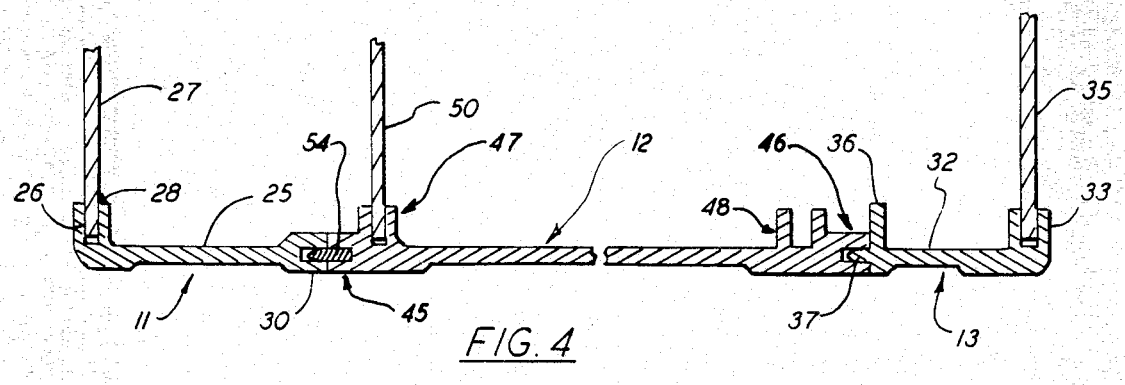
FIG. 4 is a further enlarged partial section taken along lines 4—4 in FIG. 1 showing the various sections of the case brought together in closure.

With further reference to the remaining figures, it will be shown that the modular case of the present invention is fabricated from a lightweight metal throughout to provide a case that not only can be rapidly and efficiently assembled and disassembled but also is strong and durable. The main structural element of modular sections 11–13 is a metal extrusion that is easily formed into an endless rectangular shown in FIG. 3 having four sides of equal width or depth. The loop is closed along abutting end faces as by welding to establish a smooth undetectable seam. Through use of this construction virtually any size and shape section can be manufactured from extruded metal elements without the need of costly tooling changes and the like.

The bottom cover section of the case contains a laterally disposed web 25 that dependently supports a pair of flanged elements extending about the two peripheral edges of the web. The outer edge flange of the cover includes a bottom channel 26 that is turned inwardly so that it is perpendicularly aligned in reference to the plane of the web 25. The bottom channel opens inwardly and has an aluminum panel mounted therein which forms the bottom wall of the case. The bottom panel is held in place by a series of spot welds 28—28 that are preferably situated on the inner side of the panel. The opposite or inner peripheral edge of the web supports a second dependent channel 30 which lies generally in the plane of the web and which opens outwardly. The distal end face 31 of channel 30 provides a flat surface against which coacting surfaces on the other case sections are seated when the case is closed.

Figure 5:
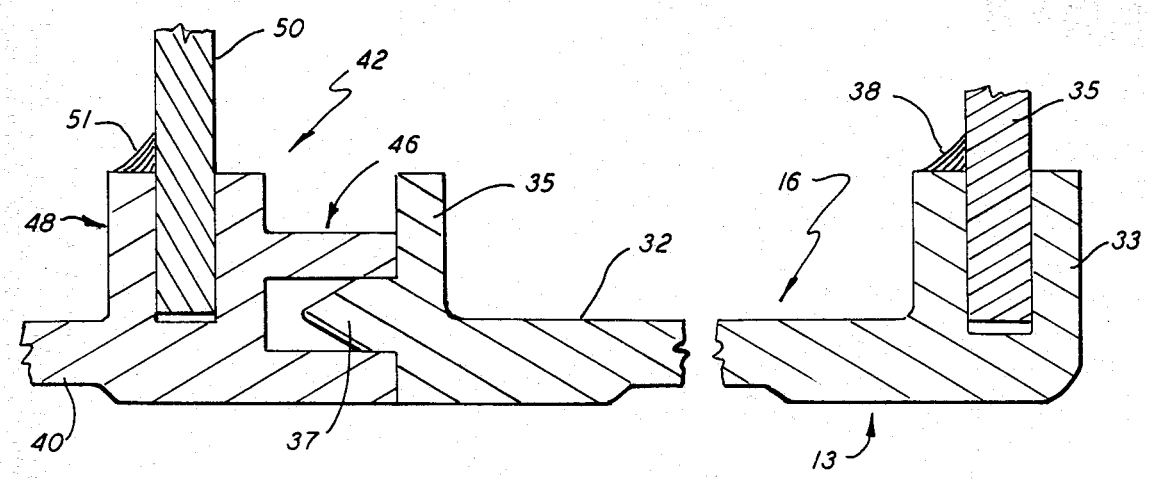
FIGS. 5 and 6 are both enlarged partial sections showing the top and bottom covers, respectively, closed against the removable center section of the case.

The top cover section 13 of the case also contains a flat web 32 that is terminated at both ends by means of a pair of flanges. As in the case of the bottom cover section, the outer peripheral edge of the cover contains a top channel that is turned inwardly so that it is generally perpendicular to the plane of the web with the channel again opening inwardly. A top panel 35 is mounted in the channel and forms the top wall of the case. The panel is secured to the top cover section by means of a series of internally positioned spot welds 38. The other or inner peripheral edge of the top cover section contains an inwardly directed stop face 36 that is perpendicularly disposed in regard to the web. A locking rib 37 is supported by the stop face and is arranged to extend outwardly from the face generally in the plane of the web. As best seen in FIG. 5, the rib is slidably received within an outwardly opening channel carried by one of the other case sections when the case is closed.

Figure 7:
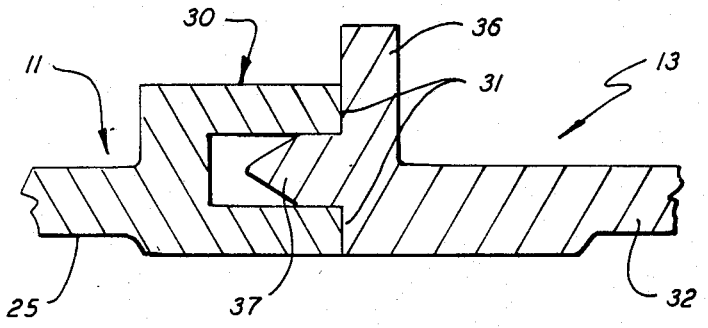
FIG. 7 is a further enlarged partial section wherein the center section of the case is removed and the top cover section is closed against the bottom cover section.

FIG. 7 depicts the case configuration when the center section or sections are removed and the top and bottom cover sections are hinged together. Closing the top cover section against the bottom cover section introduces the rib 37 in the top cover into the open channel 30 carried about the inner peripheral edge of the bottom cover. The stop face 36 of the top cover, during closure, is securely seated against the end face 31 of channel 30. As should now be evident, this interlocking arrangement permits the contacting edges of the two cover sections to be tightly closed to form a reliable joint between the two sections.

Figure 6:
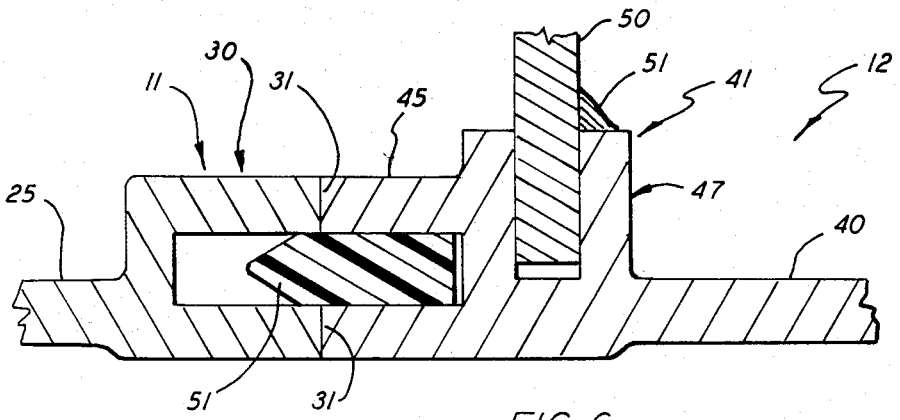

The center section 12 of the case 10 is likewise formed from a single piece of metal extrusion. The extrusion includes a central web 40 and a pair of end flanges, generally referenced 41 and 42. As best seen in FIGS. 5 and 6, the end flanges contain a first pair of outwardly disposed channels 45,46 and a second pair of inwardly disposed channels 47,48. The two outwardly disposed channels lie generally in the plane of the central web 40 while the two inwardly disposed channels, on the other hand, are turned perpendicular to the web and are adapted to open toward the interior of the case. The double channel arrangement adds considerable strength and rigidity to the center section and also, as will be explained in greater detail below, provides for the formation of an extremely tight joint between the center section and the other case forming sections against which it is closed.

Both of the channels 47 and 48 of the center section 12 provide a means for mounting panels or walls inside the case. Such a panel is shown at 50 in FIG. 3. The panels are used to divide the case into different compartments or, alternatively, as mounting surfaces for supporting equipment stored within the case. The panels are typically made of aluminum and are contained within the channel openings by a series of spot welds 51—51. The center section of the case is ideally suited for storing electronic test equipment of the type typically carried by a repairman. The equipment may be mounted in the center section between two end panels and access doors and windows are formed in the panels to provide both physical and visual access to the stored components. As can be seen, in the event the electronic test equipment must be taken out of service for any reason, the entire center section can be removed from the case and a replacement unit substituted therefor thus avoiding costly down time.

Turning once again to FIG. 6, the center section of the case is provided with a grommet that is carried in one of the outwardly opening channels. The grommet is preferably formed of a hard plastic loop that is press fitted into the open end of the channel. The grommet is furnished with a slight interference fit in regard to the receiving channel 45 so that once inserted therein the grommet will remain in place. An adhesive can be applied to the grommet to further insure that it will be retained in the channel. The distal end of the grommet extends outwardly from the end face 31 of the channel and is adapted to be received in the end channel 30 of the bottom cover section 11. By use of this grommet arrangement, the center section or sections can be quickly adapted to meet virtually any case configuration without having to make changes in the tooling or the extrusion dies. This, of course, results in a considerable savings in both time and money.

Figure 8:
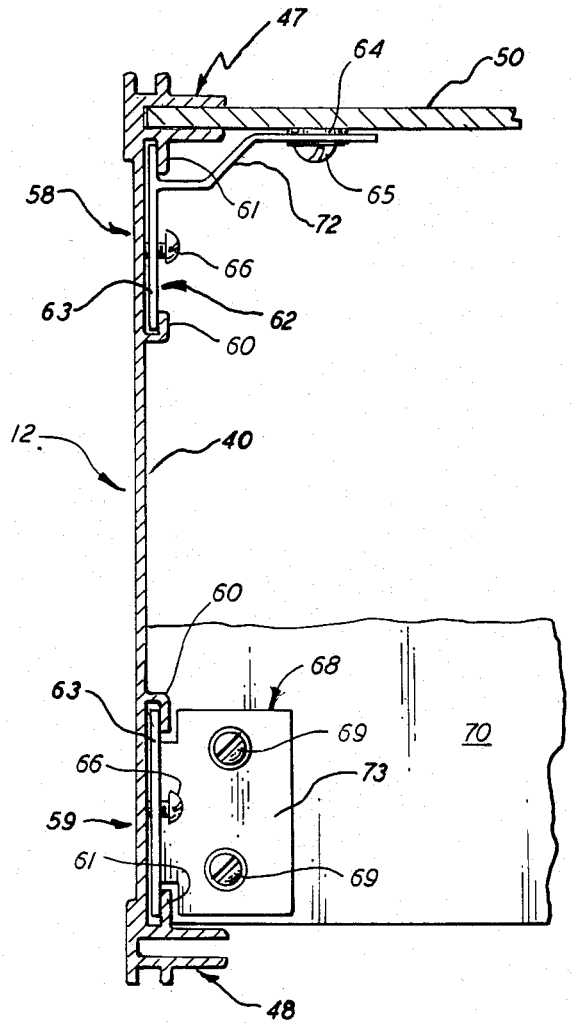
FIG. 8 is an enlarged partial front view in section showing wall brackets mounted in the center section of the case.

Turning now to FIG. 8, there is shown a further embodiment of the invention wherein interior panel support brackets are mounted along the side walls of the center section 12 of the case. A pair of slides are integrally formed with the end flanges of the section and extend around the entire inner periphery of the case.

The slides include an upper slide 58 and a lower slide 59. Each slide contains a pair of parallel rails 60 and 61 that are adapted to slidably receive therebetween either a horizontal support bracket 62 as shown mounted in the upper slide 58 or a vertical support bracket 68 as shown mounted in the lower slide 59. Although not shown, openings are furnished in the rails to allow the base plate 63 of the brackets to be inserted into a slide. Moving the plate laterally captures the plate under the rails. The bracket is brought to a desired panel supporting position and is locked in place using a setscrew 66.

The upper bracket 62 contains a horizontally disposed support flange 64 that is held to the companion base plate in coplanar alignment with the bottom surface of horizontal panel 50 by means of arm 72. In this particular arrangement, the panel 50 is carried in the interior channel 47 of the center section and the bracket is used to provide added strength to the wall structure. It should be evident that the bracket can also be inverted within the slide and thus adapted to support a horizontal panel at a second position within the case. Two or more brackets are generally employed to help support the panel with the flange of each bracket being secured to the panel by means of one or more screws 65.

The lower bracket 68 contains a vertically aligned flange 73 depending from the base plate 63 which is secured to a vertical wall 70 by screws 69—69. Here again two or more brackets are generally used to support the panel within the center section of the case. In light of the fact that the rails extend around the entire periphery of the case, the position of the vertical wall can be brought to almost any desired location within this section thus providing the case with a degree of flexibility heretofore not attainable in the art. Here again, the wall mounting structure is fully compatible with the all metal construction of the case and the slides can be easily formed as an integral part of the single piece center section.

While this invention has been described with reference to the structure disclosed herein, it is not confined to the details set forth and this application is intended to cover any modifications or changes as may come within the scope of the following claims.

I claim:

1. A modular all metal carrying case that includes a top cover section, a bottom cover section and at least one center section, take apart hinges for hingedly connecting each of the sections together whereby the cojoined sections can be closed against each other to form a carrying case, said at least one center section having a laterally extended web that is formed into an endless, generally rectangular loop, each peripheral edge of the web containing a pair of continuous open channels, one of said channels in each pair lying generally in the plane of the web and opening outwardly and the other of said channels in each pair being perpendicularly disposed in relation to the web and opening inwardly, said top and bottom cover sections each containing a laterally extended web that is formed into an endless generally rectangular loop that compliments the peripheral contour of the center section, each of said cover sections further including an outer peripheral edge that teminates in an outer channel that is perpendicular to the cover section web and which opens inwardly and an exterior metal cover panel mounted in the outer channel for enclosing the cover section, one of said cover sections further including an inwardly directed stop face along its inner peripheral edge that closes against a first outwardly opening channel on the center section, and a continuous rib outwardly disposed from the stop face that is receivable in said first outwardly opening channel when one of the said cover sections is closed against the center section, the other of said cover sections further including a continuous closure channel positioned along its inner peripheral edge that is positioned generally in the plane of the other of said cover section's web and which opens outwardly, said closure channel being arranged to seat in abutting contact against a second outwardly opening channel on the center section so that the openings of the two abutting channels are in alignment when said other cover section is claosed against the body section, and an endless grommet means removably secured in one of the two said abutting channels that closes within the other of said abutting channels when the said other cover section is closed against the center section and whereby the grommet means can be removed from the abutting channels in the event the center section is removed from the case thereby allowing the top cover section to close against the bottom cover when the two cover sections are hinged together in assembly.

2. The modular case of claim 1 wherein the said center section contains at least one metal panel secured within one of the inwardly opening channels to divide the interior of the case into compartments.

3. The modular case of claim 1 wherein said grommet means is formed from a loop of relatively rigid material that is press fitted into said second outwardly opening channel on said center section.

4. The modular case of claim 3 wherein a series of center sections are hingedly mounted between the cover sections so that an outwardly opening channel on one center section abuts an outwardly opening channel on an adjacent center section and said grommet passes between the two abutting channels when the center sections are closed against each other.

5. The modular case of claim 1 wherein the case sections are extruded aluminum parts and the panels are aluminum sheets.

6. The modular case of claim 1 that further includes a first carrying handle secured to the web of said center section and a second carrying handle secured to the web of one of the cover sections.

7. The modular case of claim 1 wherein said at least one center section further includes a slide means that extends about the inner periphery of the web having a pair of parallel guide rails depending inwardly from the web, at least two mounting brackets slidably received in said slide and an interior wall panel secured to the brackets.

8. The modular case of claim 7 that includes a first slide means mounted adjacent to the pair of channels at one edge of the web and a second slide means mounted adjacent to the pair of channels at the opposite edge of the web.

9. The modular case of claim 7 wherein each of said brackets has a mounting flange for supporting the wall panel perpendicular to the web.

10. The modular case of claim 7 wherein each of said brackets contains a mounting flange for supporting the wall panel generally parallel with a wall formed by said web.

* * * * *